United States Patent [19]

Takahashi

[11] Patent Number: 4,457,493

[45] Date of Patent: Jul. 3, 1984

[54] GAS ATMOSPHERE HEATING FURNACE

[75] Inventor: Susumu Takahashi, Yokohama, Japan

[73] Assignee: Kanto Yakin Kogyo Kabushiki Kaisha, Tokyo, Japan

[21] Appl. No.: 452,835

[22] Filed: Dec. 23, 1982

[30] Foreign Application Priority Data

Jun. 24, 1982 [JP] Japan ..... 57-108875
Aug. 5, 1982 [JP] Japan ..... 57-136774

[51] Int. Cl.[3] ..... F27B 9/40; C21D 9/00

[52] U.S. Cl. ..... 266/81; 432/198; 432/199; 266/257; 266/252

[58] Field of Search ..... 266/249–257, 266/110, 105, 111, 81, 130; 432/198, 199

[56] References Cited

U.S. PATENT DOCUMENTS

| | | | |
|---|---|---|---|
| 1,934,614 | 11/1933 | Peterson | 266/257 |
| 2,084,002 | 6/1937 | Peterson | 266/257 |
| 2,628,830 | 2/1953 | Kerr | 266/257 |
| 2,818,246 | 12/1957 | Kappel | 266/257 |
| 3,163,694 | 12/1964 | Ipsen | 266/252 |
| 3,565,409 | 2/1971 | Beck | 266/257 |
| 4,039,794 | 8/1977 | Kasper | 266/257 |
| 4,191,598 | 3/1980 | Conybean et al. | 148/16.5 |
| 4,245,818 | 1/1981 | Elhaus et al. | 266/87 |

*Primary Examiner*—L. Dewayne Rutledge
*Assistant Examiner*—Christopher W. Brody
*Attorney, Agent, or Firm*—Shlesinger, Fitzsimmons & Shlesinger

[57] ABSTRACT

A furnace for heating steel articles and so on without oxidation and decarbonization. In the furnace, non-oxidation gas atmosphere with or without cementation characteristics is produced and regenerated by subjecting the air to carbon elements and heat at a reaction chamber provided within the furnace or closely thereto, and the gas atmosphere is circulated through a substantially closed circuit with the said reaction chamber connecting outtake and intake openings of the furnace.

3 Claims, 1 Drawing Figure

GAS ATMOSPHERE HEATING FURNACE

BACKGROUND OF THE INVENTION

In a conventional heating furnace to which this invention relates, a gas atmosphere which works to prevent articles under heat treatment from oxidation and decarbonization, is discharged gradually from the furnace to the air, and replenished regularly by a fresh gas. Such fresh gas atmosphere is commonly made in a gas generating unit which is independent from the heating furnace and employs mostly a catalytic metal retort, and is supplied into the furnace after having been cooled. This is really a waste of gas atmosphere.

BRIEF SUMMARY OF THE INVENTION

In view of the above, this invention is to provide a heating furnace, in which a gas atmosphere, carbon activity of which is lowered with the operation of furnace is continuously and gradually sucked into a conduit which constitutes together with the furnace a substantially closed circulation circuit of the gas atmosphere, and is returned to the furnace after having been regenerated of its activity at a reaction chamber provided in the course of the circulation circuit and adjacently to an end of the furnace located opposite to another end of the furnace where the gas atmosphere is sucked. Heating of steel articles without oxidation and under an equilibrium of carbon is achieved in this invention by circulating a gas atmosphere in a substantially closed path and subjecting the gas to heat and carbon in said path.

BRIEF DESCRIPTION OF THE DRAWING

The accompanying drawing.

DETAILED DESCRIPTION OF THE INVENTION

Figure 1:
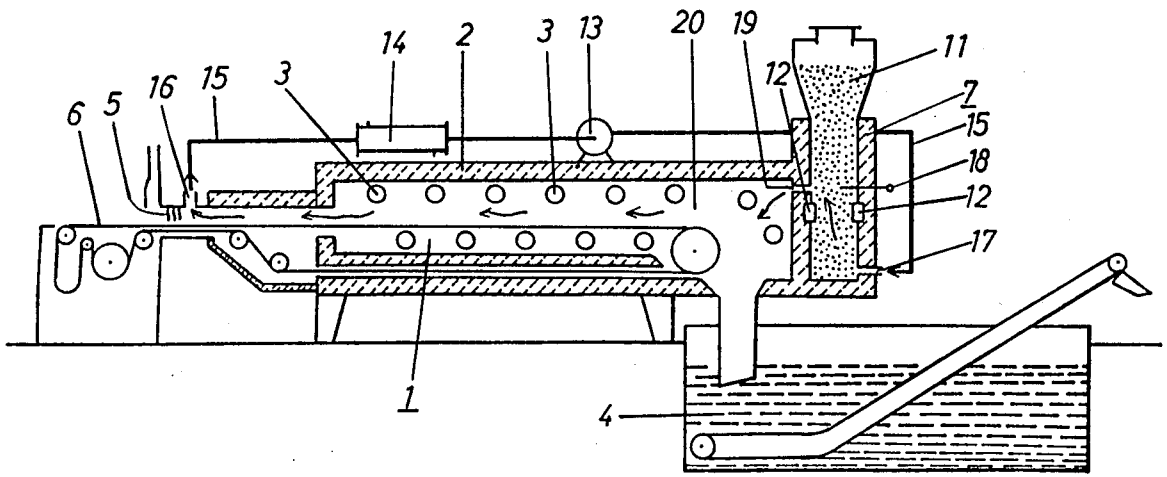
FIG. 1 shows an explanatory cross-sectional view of a heating furnace made in accordance with this invention.

In the drawing showing a furnace for heating steel articles under a non-oxidizing gas atmosphere and subsequently oil-quenching them, the furnace 1 comprises insulation walls 2 made of refractories. To a longitudinal end of the furnace located opposite to another end from which articles to be treated in the furnace are carried in, there is provided a reaction chamber 7 which opens to the furnace through an opening 19. The furnace 1 is heated by heaters 3, while the reaction chamber 7 is heated by electrodes 12 as explained hereinafter more in detail. When the furnace 1 and the reaction chamber 7 are heated to a predetermined temperature, the atmosphere within the furnace which was initially air is forcibly circulated through the following path by means of a blower 13.

Said path is consisted of an atmosphere gas outtake opening 16, an atmosphere gas cooling device 14, the aforementioned blower 13, an atmosphere intake opening 17, the aforementioned reaction chamber 7, the opening 19, an inside passage 20 of the furnace 1, and the aforementioned atmosphere gas outtake opening 16. These constituent parts of the path are communicated to each other by a conduit 15. As the end of furnace 1 from which articles to be treated are carried into the furnace is sheltered by a metal curtain 5, said path constitutes a circuit substantially closed from the air.

The reaction chamber 7 is filled with carbon granules 11. Or, in place of carbon granules, gaseous carbon such as hydrocarbon can be supplied into the chamber 7. When the pair of electrodes 12 which are provided to inside walls of the reaction chamber so as to face each other with the carbon granules therebetween, are charged with electricity, resistance heat is produced in the granules. This heat is easily controllable of its temperature by varying the charged electricity. In case where gaseous carbon is supplied to the reaction chamber, conventional heaters are provided in the chamber.

Numeral 4 indicates an oil quenching vessel, 6 a train of mesh belts, and 18 a thermocouple.

In the furnace arrangements described in the above, the furnace atmosphere which is initially the air consisting of $O_2$ of 20.9 volume % and $N_2$ of 79.1 volume %, reacts with carbon 11 in the reaction chamber 7, as follows.

$$C+4.785\ air=CO_2+3.785\ N_2,$$

and, $$CO_2+C=2CO$$

Accordingly, $$2C+4.785\ air=2CO+3.785\ N_2$$

In practice, the following reaction occurs also, since the air and carbon granules or hydrocarbon contain moisture.

$$H_2O+C=H_2+CO$$

In addition, the atmosphere contains $CO_2$ which was not converted to CO in the above equations but remains as first reacted. Hence, the air reacted with carbon makes a $N_2$ system gas atmosphere containing CO, $H_2$, $CO_2$, and unreacted trace amount of $H_2O$. When this $N_2$ gas is heated, it comes to have an equilibrium at its heated temperature, as follows.

$$H_2+CO_2 \rightleftarrows H_2O+CO$$

As known in this art, whether the said gas is oxidative or reductive against steel (viz., $Fe+H_2O \rightleftarrows FeO+H_2$ and $Fe+CO_2 \rightleftarrows FeO+CO$) is decided by ratios $H_2/H_2O$ and $CO/CO_2$ and by an equilibrium constant at a selected or given heating temperature.

For example, the carbon granules 11 were heated to 900° C., while the furnace passage 20 was also kept at 900° C. The furnace gas atmosphere obtained thereby consisted of: $N_2$ . . . 57.9%, CO . . . 35.3%, $H_2$ . . . 5.6%, $CO_2$ . . . 1.0%, and $H_20$ . . . 0.2%.

At a temperature of 900° C., it is known that when the ratio of $CO/CO_2$ is more than 2.2 and the ratio of $H_2/H_2O$ is more than 1.8, the gas is reductive. In this example, as the ratio of $CO/CO_2$ was 35.3 and the ratio of $H_2/H_2O$ was 28.0, the gas atmosphere has sufficient reducibility. And, therefore, steel articles could be heated without any oxidation.

Cementation or decarbonization characteristics of the said gas against steel are also controllable to an equilibrium solely by a heating temperature of carbon 11 within the reaction chamber 7.

To wit, in addition to the aforementioned reactions, the mixture gas undertakes the following reactions.

$$H_2O + C\ (\text{of carbon } 11) \rightleftarrows CO + H_2$$

-continued $$KP_1 \text{ (carbon potential in this instance)} = \frac{PCO \cdot PH_2}{PH_2O} \quad (1)$$

$$H_2O + C \text{ (of steel)} \rightleftarrows CO + H_2$$

$$KP_2 \text{ (carbon potential in this instance)} = \frac{PCO \cdot PH_2}{PH_2O \cdot ac} \quad (2)$$

, in which ac represents activity of carbon in the steel.

When the mixture gas is brought to an equilibrium, the $(PCO \cdot PH_2)/PH_2O$ of the formula (1) becomes constant, irrespectively of constituent composition of gas entering into the reaction chamber 7. Thereby, the carbon potential $KP_2$ of the formula (2) becomes constant at a selected temperature. Thus, steel articles could be heated without oxidation and also under a carbon equilibrium. It shall be noted also that in this invention furnace, carbon consumption is as little as of its reaction amount with nominal $O_2$ and $H_2O$ which are brought into the furnace with steel articles to be treated.

I claim:

1. A gas atmosphere heating furnace, which comprises means defining an elongated furnace passage provided at its forward end with a reception opening for metal articles to be treated in the furnace passage as they pass therethrough, and at its rearward end with a discharge opening for discharging the treated articles, first heating means in said furnace passage for heating said passage and the articles passing therethrough, conduit means extending outside of the furnace and communicating adjacent opposite ends thereof with the reception and the discharge openings respectively, of the furnace passage and forming a substantially closed circuit with said furnace passage for circulating a gas atmosphere through said passage, said conduit means including a reaction chamber positioned adjacent to and in communication with said furnace passage, and containing carbon, second heating means in said reaction chamber, and means for controlling the operation of said second heating means independently of said first heating means for maintaining the ratios of $CO/CO_2$ and $H_2/H_2O$ in the gas atmosphere such that said atmosphere is reductive.

2. A gas atmosphere heating furnace as claimed in claim 1, in which the carbon comprises carbon granules filled in the reaction chamber, and said second heating means comprises a pair of electrodes facing each other with the carbon granules disposed therebetween.

3. A gas atmosphere heating furnace as claimed in claim 1, in which the carbon comprises gaseous carbon such as hydrocarbon.

* * * * *